US011489276B2

(12) United States Patent
Osada et al.

(10) Patent No.: US 11,489,276 B2
(45) Date of Patent: Nov. 1, 2022

(54) LOW INSERTION FORCE FEMALE CONNECTION TERMINAL

(71) Applicant: Yazaki Corporation, Tokyo (JP)

(72) Inventors: Takeshi Osada, Shizuoka (JP); Tetsuya Sekino, Shizuoka (JP); Yoshifumi Shinmi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/507,940

(22) Filed: Oct. 22, 2021

(65) Prior Publication Data

US 2022/0131298 A1 Apr. 28, 2022

(30) Foreign Application Priority Data

Oct. 23, 2020 (JP) ..... JP2020-177896

(51) Int. Cl.
*H01R 13/11* (2006.01)
*H01R 4/18* (2006.01)

(52) U.S. Cl.
CPC ..... *H01R 13/113* (2013.01); *H01R 4/185* (2013.01)

(58) Field of Classification Search
CPC .. H01R 13/113; H01R 13/055; H01R 13/629; H01R 13/114; H01R 13/422; H01R 13/4223; H01R 4/48
See application file for complete search history.

(56) References Cited

U.S. PATENT DOCUMENTS 5,645,459 A * 7/1997 Fitting ..... H01R 13/11 439/852
6,547,608 B2 * 4/2003 Sato ..... H01R 13/11 439/852
8,152,576 B2 * 4/2012 Nakamura ..... H01R 13/113 439/852
8,998,657 B1 * 4/2015 Von Eckroth ..... H01R 13/113 439/810
9,017,113 B2 * 4/2015 Haga ..... H01R 13/11 439/816
9,490,563 B2 * 11/2016 Shinmi ..... H01R 13/115
9,716,332 B1 * 7/2017 Wimmer ..... H01R 13/187
(Continued)

FOREIGN PATENT DOCUMENTS

JP 5435516 B2 3/2014
JP 2016-062710 A 4/2016

*Primary Examiner* — Vanessa Girardi
(74) *Attorney, Agent, or Firm* — Sughrue Mion, PLLC

(57) ABSTRACT

A connection terminal includes a tubular electrical connection portion into which a mating connection portion of a mating terminal is inserted. The electrical connection portion is provided with an elastic piece with a first contact portion and an opposing wall disposed opposite to the elastic piece. The opposing wall includes: second contact portions disposed on a front side and a rear side in an insertion direction of the mating connection portion, and projecting toward an elastic piece side; and a curved surface located between the second contact portions and curved so as to be separated from the mating connection portion. The curved surface includes a first curved surface located on the rear side in the insertion direction and a second curved surface located on the front side in the insertion direction. A curvature of the second curved surface is set larger than a curvature of the first curved surface.

2 Claims, 7 Drawing Sheets

(56) References Cited

U.S. PATENT DOCUMENTS

| | | | | |
|---|---|---|---|---|
| 9,735,490 | B2 * | 8/2017 | Wu | H01R 13/113 |
| 2016/0079686 | A1 | 3/2016 | Shinmi | |
| 2019/0036259 | A1 * | 1/2019 | Amano | H01R 13/113 |
| 2021/0119364 | A1 * | 4/2021 | Hoffmann | H01R 31/065 |

* cited by examiner

LOW INSERTION FORCE FEMALE CONNECTION TERMINAL

CROSS REFERENCE TO RELATED APPLICATIONS

The present application claims priority to Japanese Patent Application No. 2020-177896 filed on Oct. 23, 2020, the entire contents of which are incorporated by reference herein.

BACKGROUND

Technical Field

The present invention relates to connection terminals.

Related Art

As a conventional connection terminal, there has been known a connection terminal including a terminal connection portion as a tubular electrical connection portion into which a mating connection portion, which is formed in a tab shape, of a mating terminal is inserted (see JP 2016-62710 A (Patent Literature 1)). In the terminal connection portion, a leaf spring portion is provided as an elastic piece, which is elastically deformable and has a spring-side projection portion as a contact portion to be brought into contact with the mating connection portion. Further, a protrusion portion is provided as an opposing wall, which is disposed opposite the spring-side projection portion of the leaf spring portion.

In this connection terminal, projection portions are provided on the protrusion portion as a pair of contact portions, which are disposed on the front side and the rear side in the insertion direction of the mating connection portion, and which protrude toward the elastic piece side and are brought into contact with the mating connection portion. The protrusion portion is provided with a curved surface located between the pair of projection portions along the insertion direction of the mating connection portion and curved so as to be separated from the mating connection portion.

In such a connection terminal as described above, the spring-side projection portion of the leaf spring portion and the pair of projection portions of the protrusion portion contact with the mating connection portion in a sandwich manner, which is inserted into the terminal connection portion, by the elastic recovering force of the leaf spring portion, and the connection terminal and the mating terminal are electrically connected. Thus, the spring-side projection portion and the pair of projection portions are in contact with the mating connection portion at three points, and a stable contact can be obtained.

SUMMARY

In the connection terminal as described in Patent Literature 1, the opposing wall is provided with a curved surface, which is located between the pair of projection portions along the insertion direction of the mating connection portion and is curved so as to be separated from the mating connection portion.

When the mating connection portion is inserted into the electrical connection portion while being tilted such that the mating connection portion is brought into contact with the first contact portion of the elastic piece, the tip end side of the mating connection portion brought into contact with a portion of the curved surface located on the front side in the insertion direction of the mating connection portion. In the aforementioned initial state of insertion of the mating connection portion, elastic deformation of the elastic piece does not occur, and thus biasing force due to the recovering of the elastic piece is not applied to the mating connection portion yet.

When the insertion of the mating connection portion proceeds from this state, the tip end side of the mating connection portion slides on the curved surface, the mating connection portion moves along the curved surface, and elastic deformation of the elastic piece occurs. At this time, the first contact portion of the elastic piece slides on the mating connection portion by the biasing force caused by the recovering of the elastic piece.

When the mating connection portion is completely inserted into the electrical connection portion, the mating connection portion is guided along the curved surface to the second contact portion of the opposing wall located on the front side in the insertion direction of the mating connection portion, and the first contact portion and the pair of second contact portions are brought into contact with the mating connection portion by the biasing force caused by the restoration of the elastic piece. By providing the curved surface to the opposing wall, the mating connection portion can be guided to a normal position by the curved surface even if the mating connection portion is inserted into the electrical connection portion while being tilted.

In the connection terminal having such a curved surface as described above, elastic deformation of the elastic piece occurs when the mating connection portion slides on the curved surface, and the first contact portion of the elastic piece slides on the mating connection portion by the biasing force caused by the restoration of the elastic piece. Such slides of the curved surface and the first contact portion on the mating connection portion occur may generate wear debris. Since there is a possibility that the wear debris is interposed between the mating connection portion and the first contact portion or between the mating connection portion and the second contact portions, there is a concern that the electrical connection reliability between the connection terminal and the mating terminal deteriorates.

The present invention has been made in view of such problems as described above. An object of the present invention is to provide a connection terminal capable of reducing the amount of wear debris and improving electrical connection reliability.

A connection terminal according to the present embodiment include: an electrical connection portion into which a mating connection portion, which is formed in a tab shape, of a mating terminal is inserted, the electrical connection portion being formed in a tubular shape; an elastic piece provided in the electrical connection portion, being elastically deformable, and including a first contact portion being in contact with the mating connection portion; an opposing wall provided in the electrical connection portion and disposed opposite to the first contact portion of the elastic piece; a pair of second contact portions provided on the opposing wall and disposed on a front side and a rear side in an insertion direction of the mating connection portion, and projecting toward an elastic piece side and being in contact with the mating connection portion; and a curved surface provided on the opposing wall and located between the pair of second contact portions along the insertion direction of the mating connection portion and curved so as to be separated from the mating connection portion; wherein the curved surface includes: a first curved surface located on the rear side in the insertion direction of the mating connection portion; and a second curved surface located on the front side in the insertion direction of the mating connection portion, on which the mating connection portion slides when the mating connection portion is inserted into the electrical connection portion while being tilted; and a curvature of the second curved surface is set larger than a curvature of the first curved surface.

A boundary portion between the second curved surface and the second contact portion on the front side in the insertion direction of the mating connection portion may be formed of a curved surface.

According to the present invention, it is possible to provide a connection terminal capable of reducing the amount of wear debris and improving electrical connection reliability.

DESCRIPTION OF EMBODIMENTS

Figure 1:
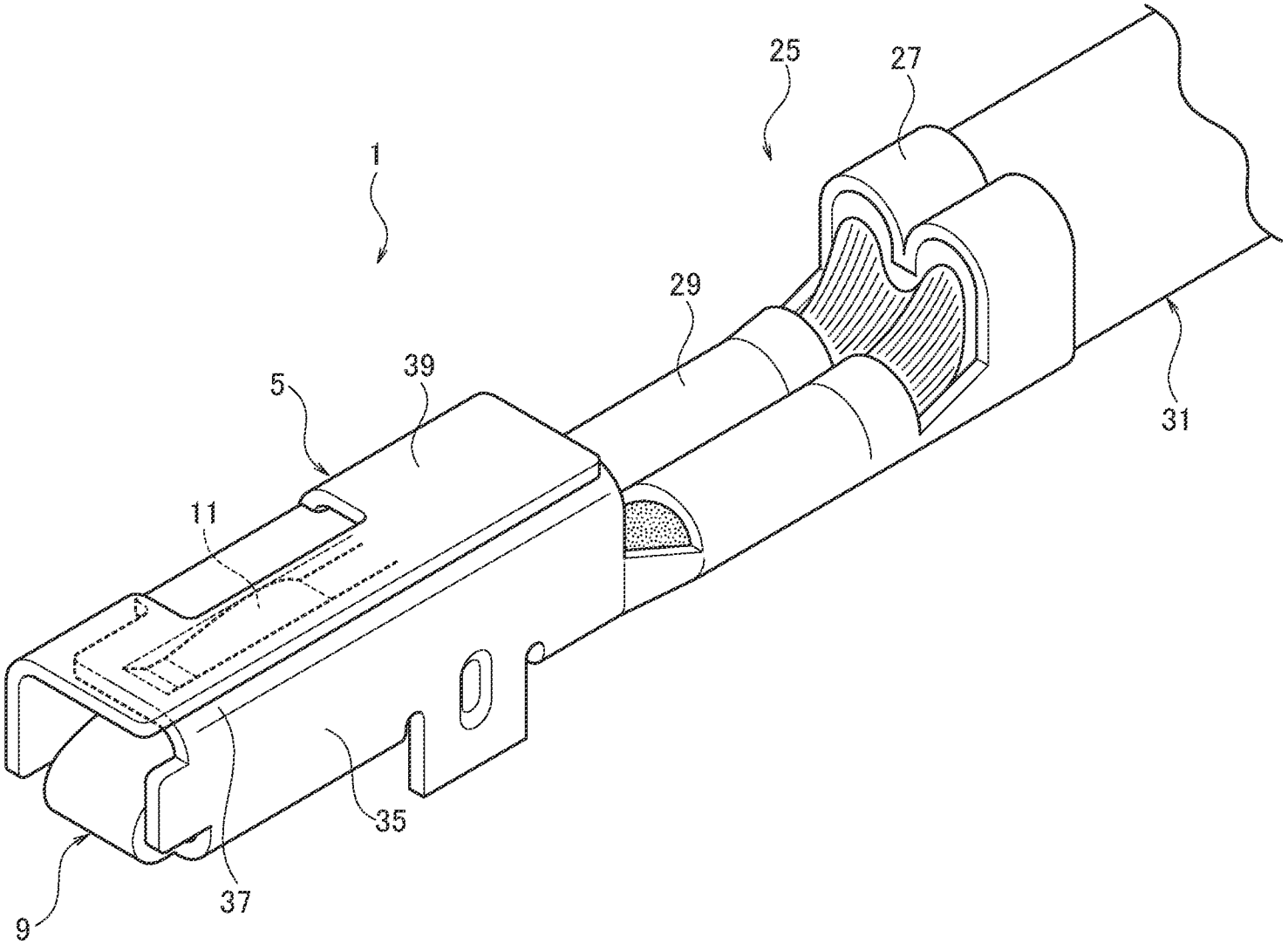
FIG. 1 is a perspective view illustrating a connection terminal according to the present embodiment.
Figure 2:
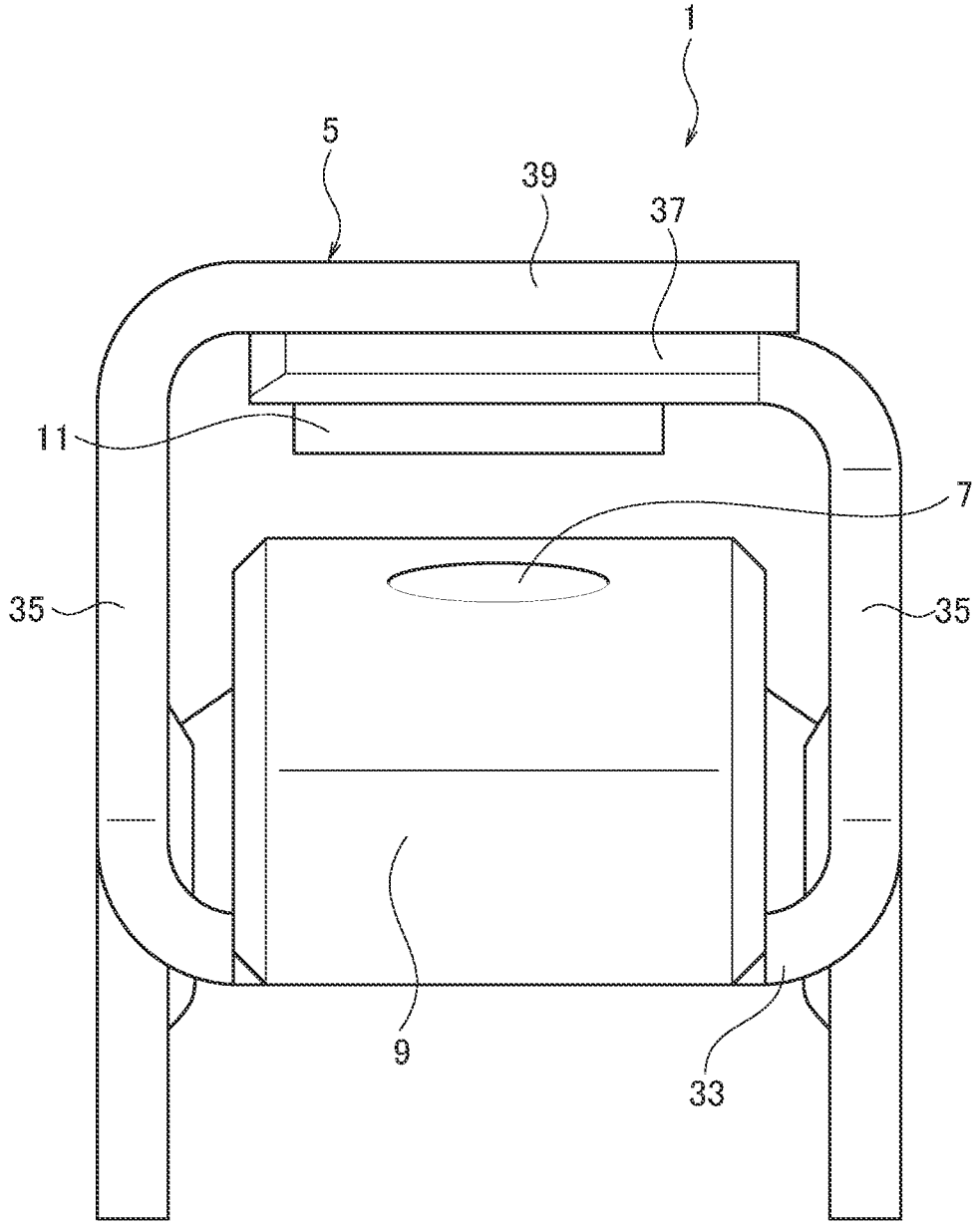
FIG. 2 is a front view illustrating the connection terminal according to the present embodiment.
Figure 3:
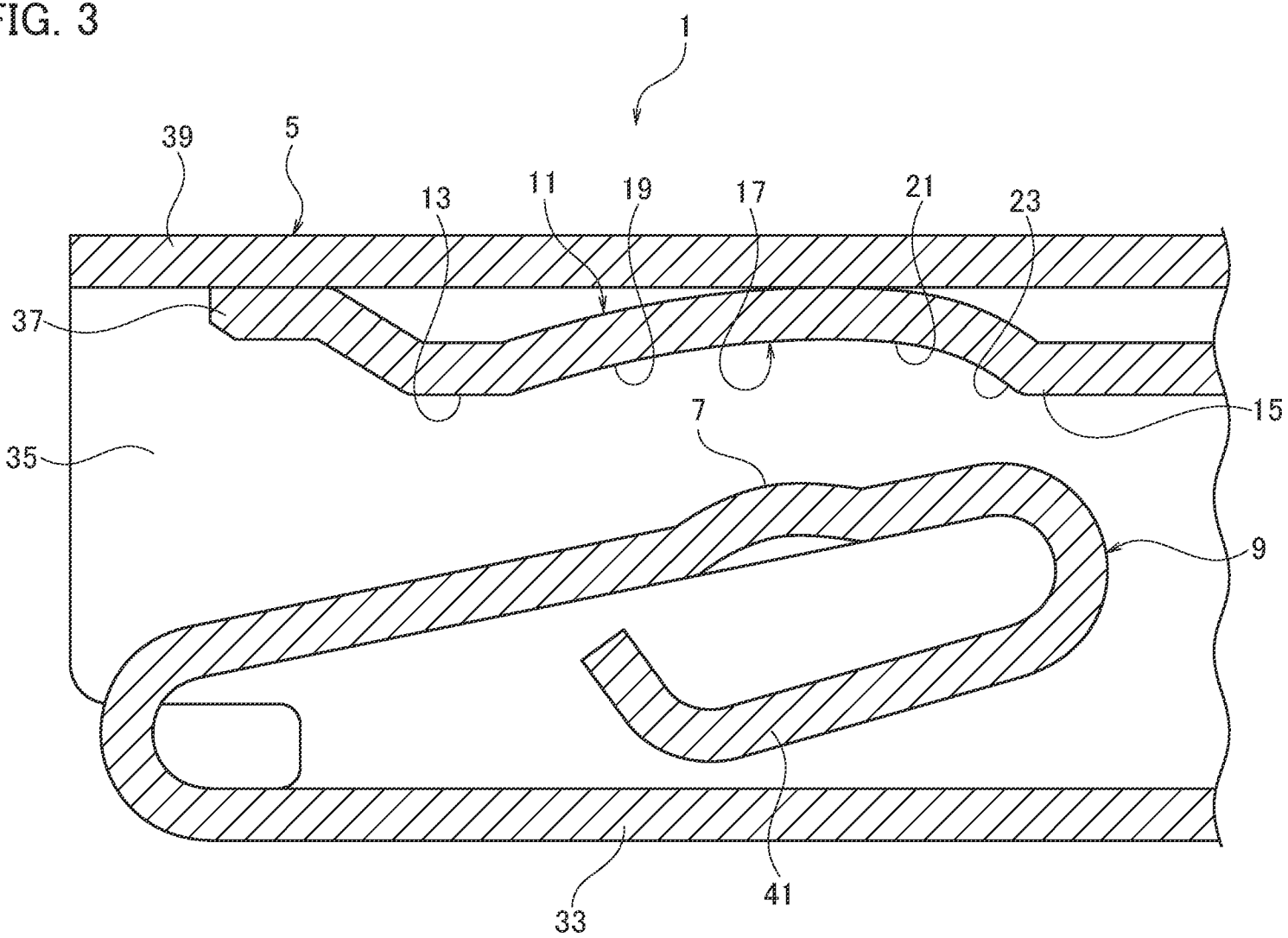
FIG. 3 is a cross-sectional view illustrating the connection terminal according to the present embodiment.
Figure 4:
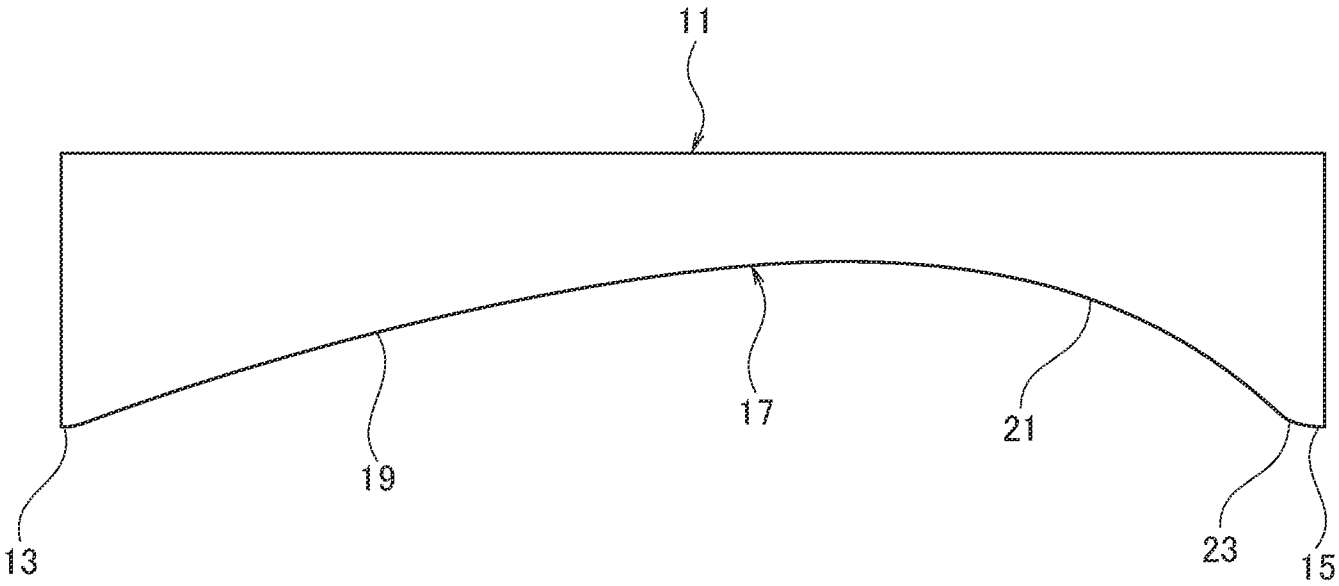
FIG. 4 is a schematic view illustrating an opposing wall of the connection terminal according to the present embodiment.

Hereinafter, the connection terminal according to the present embodiment will be described in detail with reference to the drawings. It should be noted that the dimensional ratio in the drawings is exaggerated for convenience of explanation, and may differ from the actual ratio.

The connection terminal 1 according to the present embodiment includes an electrical connection portion 5 into which a mating connection portion 3, which is formed in a tab shape, of a mating terminal is inserted. The electrical connection portion 5 is formed in a tubular shape.

In the electrical connection portion 5, an elastic piece 9 and an opposing wall 11 are provided. The elastic piece 9 is elastically deformable, and including a first contact portion 7 which is in contact with the mating connection portion 3. The opposing wall 11 is disposed opposite to the first contact portion 7 of the elastic piece 9.

Further, the opposing wall 11 is provided with a pair of second contact portions 13 and 15. The second contact portions 13 and 15 are disposed on the front side and the rear side in the insertion direction of the mating connection portion 3, respectively. The second contact portions 13 and 15 project toward the elastic piece 9 side and are in contact with the mating connection portion 3. The opposing wall 11 is provided with a curved surface 17 located between the pair of second contact portions 13 and 15 along the insertion direction of the mating connection portion 3. The curved surface 17 is curved so as to be separated from the mating connection portion 3.

Further, the curved surface 17 includes a first curved surface 19 and a second curved surface 21. The first curved surface 19 is located on the rear side in the insertion direction of the mating connection portion 3. The second curved surface 21 is located on the front side in the insertion direction of the mating connection portion 3. The mating connection portion 3 slides on the second curved surface 21 when it is inserted into the electrical connection portion 5 while being tilted.

A curvature of the second curved surface 21 is set larger than A curvature of the first curved surface 19.

A boundary portion (connection portion) 23 between the second curved surface 21 and the second contact portion 15 is formed of a curved surface.

Although not shown, the connection terminal 1 according to the present embodiment is accommodated in a housing, for example, to constitute a connector. This connector is fitted to a mating connector in which the mating terminal is housed in a mating housing. By fitting the connector to the mating connector or vise versa, the connection terminal 1 and the mating terminal are electrically connected.

Figure 5:
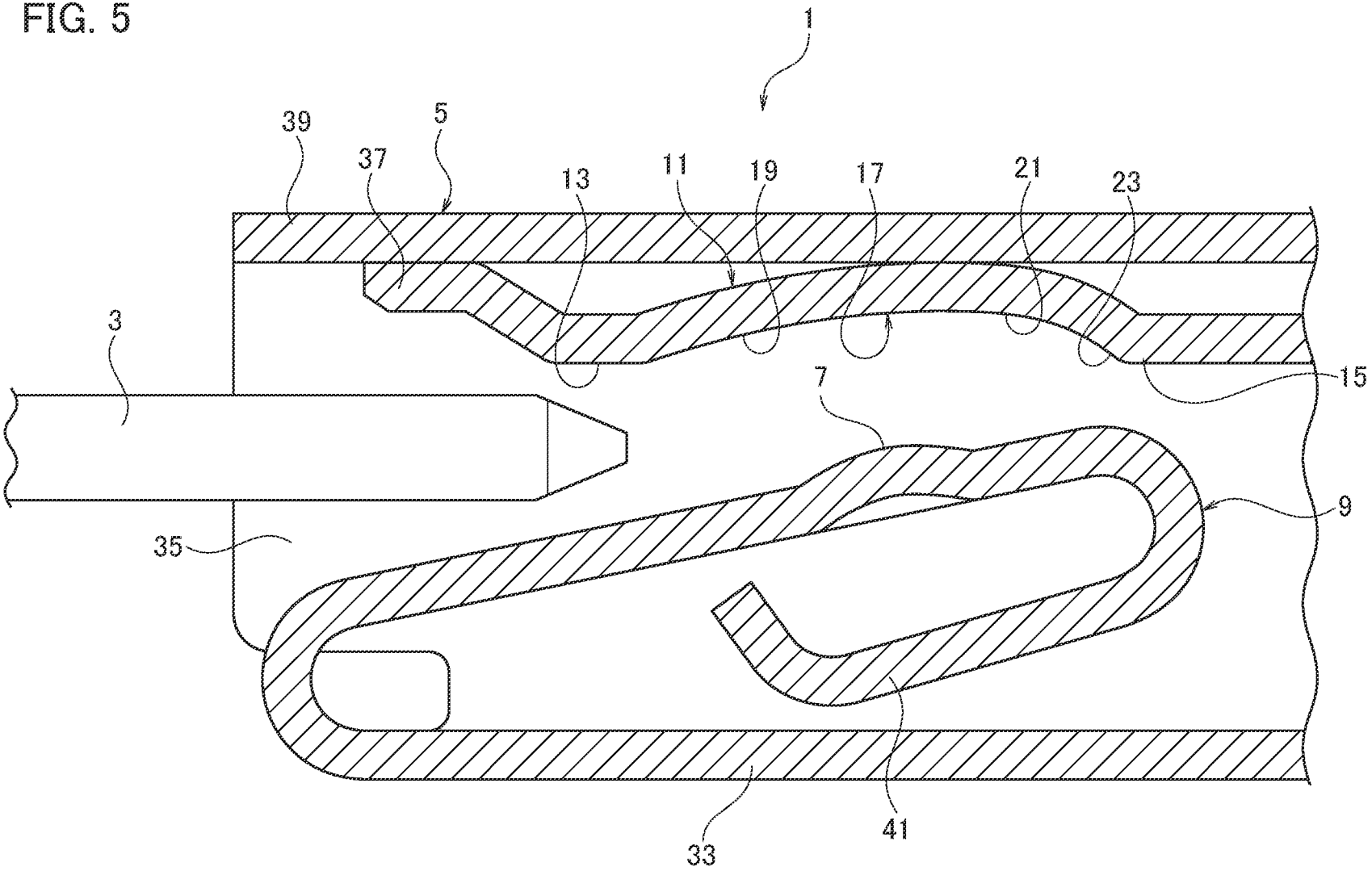
FIG. 5 is a cross-sectional view illustrating a case where a mating connection portion is inserted into an electrical connection portion of the connection terminal according to the present embodiment.
Figure 6:
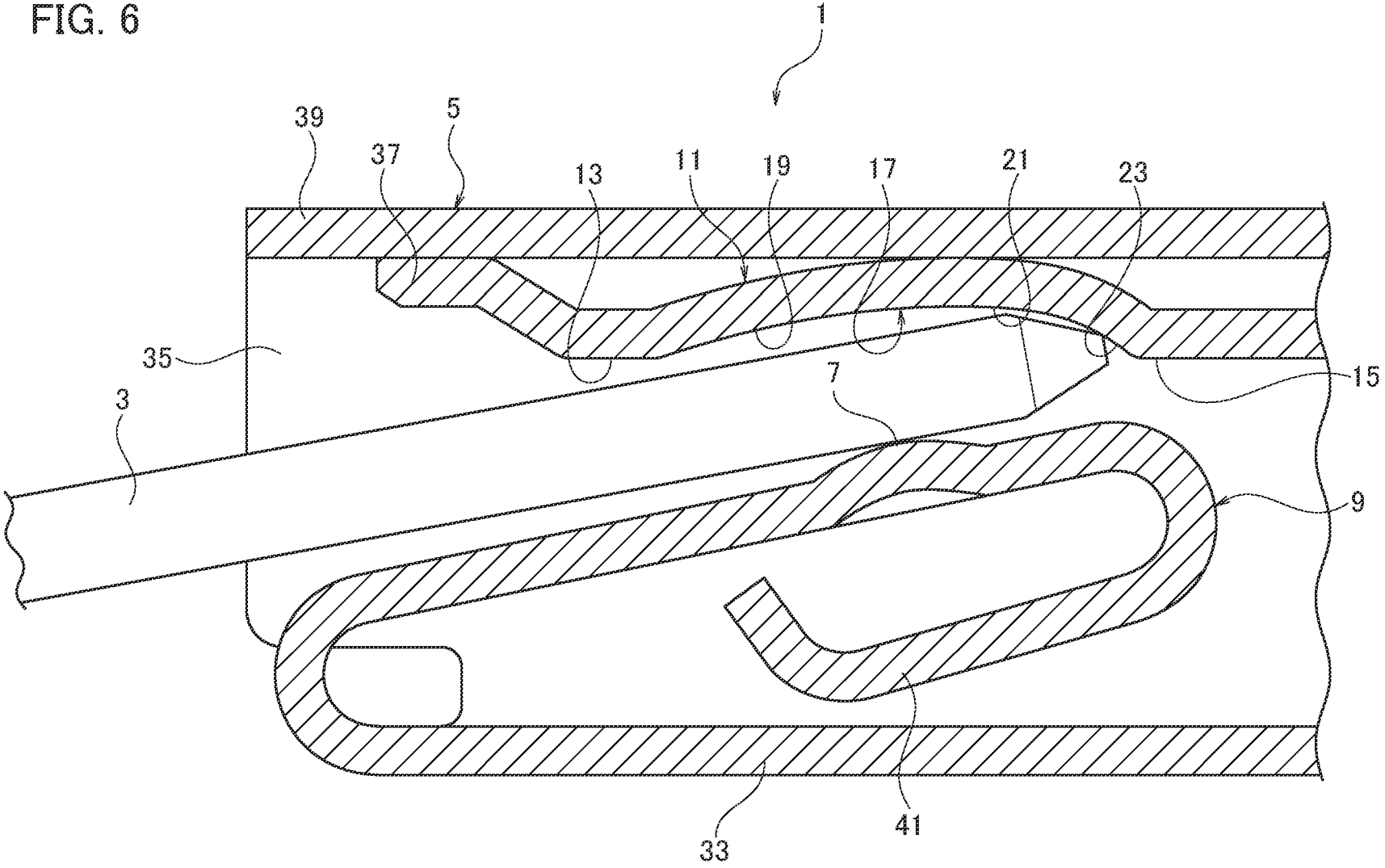
FIG. 6 is a cross-sectional view illustrating a case where the mating connection portion is inserted into the electrical connection portion of the connection terminal according to the present embodiment while being tilted.
Figure 7:
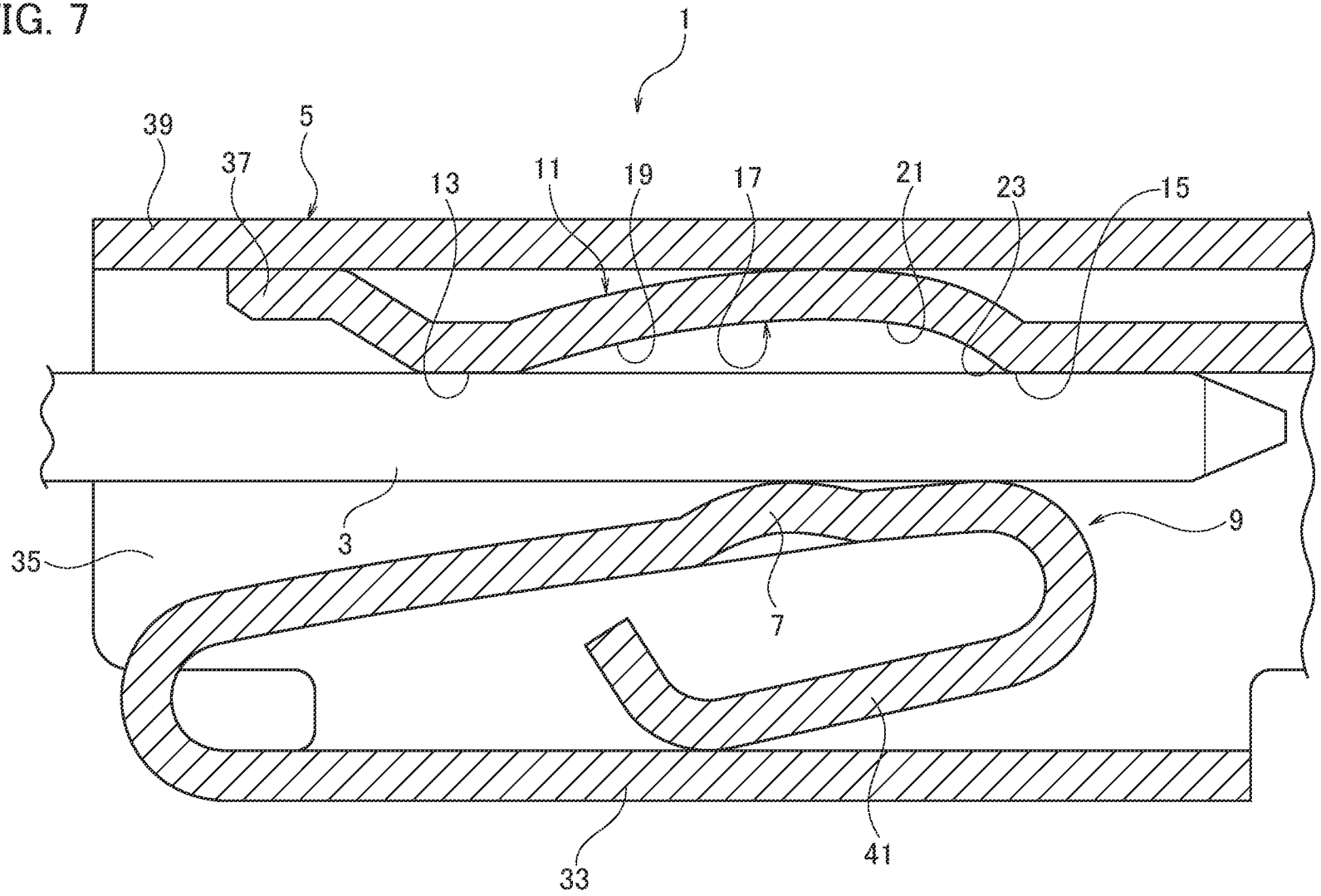
FIG. 7 is a cross-sectional view illustrating a case where the mating connection portion is inserted into an electrical connection portion of the connection terminal according to the present embodiment.

As shown in FIGS. 5 to 7, the mating terminal (not shown) is electrically connected to an electric wire by crimping or the like, for example, to an end portion of the electric wire which is electrically connected to an electric apparatus such as a power supply or other electric equipment. The mating terminal includes the mating connection portion 3 extending along the fitting direction of the connector and the mating connector. The mating connection portion 3 is formed in a tab shape. By fitting the connector to the mating connector, the mating connection portion 3 of the mating terminal is inserted into the electrical connection portion 5 of the connection terminal 1, and the mating terminal is electrically connected to the connection terminal 1.

As shown in FIGS. 1 to 7, the connection terminal 1 is formed by punching or bending a sheet of conductive material. The connection terminal 1 includes an electric wire connection portion 25 and an electrical connection portion 5.

The electric wire connection portion 25 includes a sheath-crimping portion 27 and a core-wire-crimping portion 29.

The sheath-crimping portion 27 includes a pair of crimping pieces. For example, the sheath-crimping portion 27 is crimped with a sheath of the electric wire 31 at the end of the electric wire 31, which is electrically connected to an electric apparatus such as a power supply or other electric equipment. The connection terminal 1 is fixed to the electric wire 31 by crimping the sheath-crimping portion 27 with the sheath of the electric wire 31.

The core-wire-crimping portion 29 includes a pair of crimping pieces provided between the electrical connection portion 5 and the sheath-crimping portion 27. The core-wire-crimping portion 29 is crimped with the core wire of the electric wire 31, which is exposed from the sheath of the electric wire 31, at the end of the electric wire 31. By crimping the core-wire-crimping portion 29 to the core wire portion of the electric wire 31, the connection terminal 1 is electrically connected to the electric wire 31.

The electrical connection portion 5 is formed in a square tubular shape by applying a bending process to one conductive material as a single member, in which a bottom wall 33, side walls (first and second side walls) 35 and 35, an upper wall 37, and an overlapping wall 39 are continuously connected (formed). The bottom wall 33 is positioned below the electrical connection portion 5 in the height direction. The side walls 35 and 35 are located on both sides of the bottom wall 33 in the width direction of the electrical connection portion 5, and stand on the bottom wall 33 in the height direction of the electrical connection portion 5. The upper wall 37 is continuously connected to the first side wall 35, and is bent toward the second side wall 35. The upper wall 37 is positioned on the upper side of the electrical connection portion 5 in the height direction. The overlapping wall 39 is continuously connected to the second side wall 35. The overlapping wall 39 is bent toward the first side wall 35 so that it is overlapped on or above the upper wall 37 in the height direction of the electrical connection portion 5.

The electrical connection portion 5 and the electric wire connection portion 25 are formed from the aforementioned single member, and they are continuously connected to each other. The electrical connection portion 5 is opened on a side opposite to the electric wire connection portion 25 so that the mating connection portion 3 can be inserted thereinto. In (inside) the electrical connection portion 5, the elastic piece 9 and the opposing wall 11 are provided.

The elastic piece 9 is formed from the aforementioned single member and continuously connected with the bottom wall 33. The elastic piece 9 is formed by bending a portion of this member extended from the bottom wall 33 in the length direction of the electrical connection portion 5 toward the bottom wall 33. The elastic piece 9 is elastically deformable in the height direction of the electrical connection portion 5 so that a bent portion bent from the bottom wall 33 is served as a base end and a folded portion positioned inside the electrical connection portion 5 is served as a free end. On the free end side of the elastic piece 9, there is provided a deformable portion 41 which can be elastically deformed by further folding back the free end toward the base end. When the elastic piece 9 is elastically deformed by insertion of the mating connection portion 3, the deformable portion 41 abuts on the bottom wall 33 to elastically deform, and applies a recovering force caused by the elastic deformation to the mating connection portion 3.

The elastic piece 9 is embossed from the bottom wall 33 side toward the upper wall 37 side, whereby a first contact portion 7 having a spherical shape is protrusively provided. The first contact portion 7 may be protrusively formed in a linear shape or curved shape in the width direction of the elastic piece 9 by bending the elastic piece 9. The first contact portion 7 elastically contacts the mating connection portion 3 inserted from the opening of the electrical connection portion 5 by the biasing force of the elastic piece 9, and electrically connects the connection terminal 1 and the mating terminal.

The opposing wall 11 projects toward the inside of the electrical connection portion 5 by embossing the upper wall 37 from the overlapping wall 39 side toward the inside of the electrical connection portion 5. The opposing wall 11 extends in the insertion direction of the mating connection portion 3. The opposing wall 11 is provided with a pair of second contact portions 13 and 15 and a curved surface 17.

The second contact portion 13 and the second contact portion 15 are located on the rear side and the front side in the insertion direction of the mating connection portion 3 of the opposing wall 11, respectively. The second contact portions 13 and 15 are projected toward the elastic piece 9. The second contact portions 13 and 15 are brought into contact with a mating connection portion 3 inserted through the opening of the electrical connection portion 5, and electrically connects the connection terminal 1 and the mating terminal. The biasing force of the elastic piece 9 forces the first contact portion 7 and the pair of second contact portions 13 and 15 to sandwich the mating connection portion 3. With this sandwiching, the contact state between the first contact portion 7 and the pair of second contact portions 13 and 15 is maintained. Accordingly, the electrical connection reliability between the connection terminal 1 and the mating terminal can be improved by contacting the mating connection portion 3 at three contact points of the pair of second contact portions 13 and 15 and first contact portion 7.

The curved surface 17 is located between the second contact portions 13 and 15 along the insertion direction of the mating connection portion 3. The curved surface 17 is formed in a curved shape recessed toward the overlapping wall 39 side so as to separate from the mating connection portion 3 when the mating connection portion 3 is properly inserted into the electrical connection portion 5 (see FIG. 7). The curved surface 17 includes a first curved surface 19 and a second curved surface 21.

The first curved surface 19 is provided from the second contact portion 13 on the rear side in the insertion direction of the mating connection portion 3 to a portion located on the front side in the insertion direction of the mating connection portion 3 with respect to a portion facing the first contact portion 7. The first curved surface 19 is formed such that the mating connection portion 3 doesn't abut (slide) on the first curved surface 19 even if the mating connection portion 3 is inserted into the electrical connection portion 5 while being tilted and contacts with the first contact portion 7 of the elastic piece 9 (see FIG. 6).

The second curved surface 21 is provided from the end of the first curved surface 19 on the front side in the insertion direction of the mating connection portion 3 to the second contact portion 15 on the front side in the insertion direction of the mating connection portion 3. A connection portion between the first curved surface 19 and the second curved surface 21 may be formed in a plane as long as the mating connection portion 3 does not abut even if the mating connection portion 3 is inserted while being tilted. The second curved surface 21 is formed such that the mating connection portion 3 abuts (slides) on the second curved surface 21 when it is inserted into the electrical connection portion 5 while being tilted (see FIG. 6) so as to contact the first contact portion 7 of the elastic piece 9.

With such a second curved surface 21, when the mating connection portion 3 is inserted in an inclined manner, the tip end side of the mating connection portion 3 slides, causing the mating connection portion 3 to move along the second curved surface 21, and guiding the mating connection portion 3 to the second contact portion 15 on the front side in the insertion direction. By providing the second curved surface 21 to the curved surface 17 in this manner, even if the mating connection portion 3 is inserted into the electrical connection portion 5 while being tilted, the mating connection portion 3 can be guided to a normal insertion position (see FIG. 7).

The elastic piece 9 does not elastically deform yet in the initial state of the mating connection portion 3 in which the mating connection portion 3 is inserted into the electrical connection portion 5 while being tilted and the tip side of the mating connection portion 3 abuts on the second curved surface 21. Therefore, no biasing force, which is caused by the restoration of the elastic piece 9, is applied to the mating connection portion 3, and the first contact portion 7 is not pressed by the mating connection portion 3. When the inclination of the mating connection portion 3 with respect to the insertion direction becomes small, the biasing force is generated in the elastic piece 9. However, since this biasing force is small, and the sliding between the first contact portion 7 and the mating connection portion 3 is not likely to generate the wear debris until the mating connection portion 3 comes into contact with the second curved surface 21.

When the insertion of the mating connection portion 3 proceeds from the initial state of insertion in which the mating connection portion 3 abuts on the second curved surface 21, the tip side of the mating connection portion 3 slides on the second curved surface 21, and the mating connection portion 3 moves along the second curved surface 21, whereby elastic deformation is generated in the elastic piece 9. At this time, the first contact portion 7 of the elastic piece 9 slides while being pressed to the mating connection portion 3 by the biasing force caused by the restoration of the elastic piece 9.

When the second curved surface 21 and the first contact portion 7 slide on the mating connection portion 3 during a large biasing force is generated in the elastic piece 9, there is a possibility that wear debris is generated. This wear debris may be interposed between the mating connection portion 3 and the first contact portion 7, or between the mating connection portion 3 and the second contact portions 13 and 15, and may degrade the electrical connection reliability between the connection terminal 1 and the mating terminal.

If the curvature of the second curved surface 21 is set to be the same as the curvature of the first curved surface 19, a sliding distance that the mating connection portion 3 and the second curved surface 21 slide on each other becomes long. Therefore, a sliding distance that the mating connection portion 3 and the first contact portion 7 slide on each other during a large biasing force is generated in the elastic piece 9 becomes long. The longer the sliding distances of the second curved surface 21 and the first contact portion 7 with respect to the mating connection portion 3, the larger the amount of wear debris thus generated, and the higher the possibility that the electrical connection reliability between the connection terminal 1 and the mating terminal deteriorates.

Therefore, the curvature of the second curved surface 21 is set larger than the curvature of the first curved surface 19. Specifically, a radius of a circle forming the second curved surface 21 is set to about half of a radius of a circle forming the first curved surface 19. The curvature of the second curved surface 21 may be larger than the curvature of the first curved surface 19, and the curvature of the second curved surface 21 may be set appropriately.

By setting the curvature of the second curved surface 21 in this way, the second curved surface 21 is more tightly curved than the first curved surface 19. Therefore, in the electrical connection portion 5, the second curved surface 21 is located at a deep position in an obliquely upward direction, which is a combined direction of the insertion direction of the mating connection portion 3 and the height (upward) direction of the electrical connection portion 5.

By arranging the second curved surface 21 in this way, the sliding distance that the mating connection portion 3 and the second curved surface 21 slide on each other becomes shorter when the mating connection portion 3 is inserted in an inclined manner. Therefore, the sliding distance that mating connection portion 3 and the first contact portion 7 slide on each other during a large biasing force is generated in the elastic piece 9 becomes shorter. Accordingly, it is possible to reduce the amount of wear debris, and improve the electrical connection reliability between the connection terminal 1 and the mating terminal.

If the boundary portion 23 between the second curved surface 21 and the second contact portion 15 on the front side in the insertion direction of the mating connection portion 3 would be sharp or angular, the resistance in sliding of the mating connection portion 3 from the second curved surface 21 to the second contact portion 15 would be increased. If the resistance unnecessarily increases, the operator's feeling obtained when fitting the connector to the mating connector or vice versa deteriorates. In this case, the operator may stop the fitting on the way. Similarly, even when the operator directly fits the connection terminal 1 to the mating terminal or vice versa, this feeling deteriorates and the operator stops the fitting on the way.

Therefore, the boundary portion 23 between the second curved surface 21 and the second contact portion 15 on the front side in the insertion direction of the mating connection portion 3 may be formed of a curved surface. By forming the boundary portion 23 with a curved surface in this manner, the mating connection portion 3 can move smoothly along the curved surface of the boundary portion 23. Accordingly, the deterioration of the feeling when the connector and the mating connector are fitted to each other or the connection terminal 1 and the mating terminal are fitted to each other is suppressed, and it is possible to prevent the operator from stopping the fitting on the way.

In the connection terminal 1, the curvature of the second curved surface 21 is set larger than the curvature of the first curved surface 19. Therefore, when the mating connection portion 3 is inserted into the electrical connection portion 5 while being tilted, it is possible to reduce the sliding distance when the second curved surface 21 and the mating connection portion 3 slide on each other. In addition, it is possible to reduce the sliding distance when the mating connection portion 3 and the first contact portion 7 slide on each other during a large biasing force is generated in the elastic piece 9.

Accordingly, in the connection terminal 1, it is possible to reduce the amount of wear debris generated due to the sliding between the first contact portion 7 or the second curved surface 21 and the mating connection portion 3, and improve electrical connection reliability.

The boundary portion 23 between the second curved surface and the second contact portion 15 is formed of a curved surface. Therefore, the mating connection portion 3 can smoothly move from the second curved surface 21 to the second contact portion 15 along the curved surface of the boundary portion 23. Accordingly, it is possible to suppress the deterioration of the feeling when the connection terminal 1 and the mating terminal are fitted to each other, and prevent an operator from stopping the fitting on the way.

Although the present embodiment has been described above, the present embodiment is not limited thereto, and various modifications can be made within the scope of the subject matter of the present embodiment.

For example, in the connection terminal according to the present embodiment, the connection terminal is electrically connected to the mating terminal by fitting the connector to the mating connector, but the connection terminal and the mating terminal may be directly electrically connected.

Although the electrical connection portion is formed in a square tubular shape, it is not limited thereto, and the electrical connection portion may have any tubular shape such as a round tubular shape.

What is claimed is:

1. A connection terminal comprising:

an electrical connection portion into which a mating connection portion, which is formed in a tab shape, of a mating terminal is inserted, the electrical connection portion being formed in a tubular shape;

an elastic piece provided in the electrical connection portion, being elastically deformable, and including a first contact portion being in contact with the mating connection portion;

an opposing wall provided in the electrical connection portion and disposed opposite to the first contact portion of the elastic piece;

a pair of second contact portions provided on the opposing wall and disposed on a front side and a rear side in an insertion direction of the mating connection portion, and projecting toward an elastic piece side and being in contact with the mating connection portion; and a curved surface provided on the opposing wall and located between the pair of second contact portions along the insertion direction of the mating connection portion and curved so as to be separated from the mating connection portion; wherein the curved surface includes:

a first curved surface located on the rear side in the insertion direction of the mating connection portion; and a second curved surface located on the front side in the insertion direction of the mating connection portion, on which the mating connection portion slides when the mating connection portion is inserted into the electrical connection portion while being tilted; and a curvature of the second curved surface is set larger than a curvature of the first curved surface.

2. The connection terminal according to claim 1, wherein a boundary portion between the second curved surface and the second contact portion on the front side in the insertion direction of the mating connection portion is formed of a curved surface.

* * * * *